US011751661B2

(12) United States Patent
Cheng et al.

(10) Patent No.: US 11,751,661 B2
(45) Date of Patent: Sep. 12, 2023

(54) REFILLABLE COMPACT CASE

(71) Applicant: L'OREAL, Paris (FR)

(72) Inventors: Wenzhen Cheng, Annadale, NJ (US); Hadir Osman, Tinton Falls, NJ (US); Thomas Kearney, Scotch Plains, NJ (US); William Blake Soeters, Middletown, NJ (US); Pierre Gardet, Cuisery (FR); Florence Trotet, Paris (FR); Laurence Marchand, Avon (FR)

(73) Assignee: L'Oreal, Paris (FR)

( * ) Notice: Subject to any disclaimer, the term of this patent is extended or adjusted under 35 U.S.C. 154(b) by 111 days.

(21) Appl. No.: 17/245,528

(22) Filed: Apr. 30, 2021

(65) Prior Publication Data

US 2022/0346522 A1 Nov. 3, 2022

(51) Int. Cl.

| | |
|---|---|
| ***A45D 33/24*** | (2006.01) |
| ***A45D 33/00*** | (2006.01) |
| ***A45D 40/22*** | (2006.01) |

(52) U.S. Cl.

CPC ..... *A45D 33/008* (2013.01); *A45D 40/22* (2013.01); *A45D 2200/05* (2013.01)

(58) Field of Classification Search

CPC .... A45D 33/00; A45D 33/003; A45D 33/006; A45D 33/008; A45D 33/04; A45D 33/06; A45D 40/0068; A45D 40/0075; A45D 40/21; A45D 2200/005

See application file for complete search history.

(56) References Cited

U.S. PATENT DOCUMENTS

| | | | | |
|---|---|---|---|---|
| 4,421,127 | A * | 12/1983 | Geer | A45D 40/22 206/823 |
| 4,826,014 | A | 5/1989 | Schefer | |
| 5,908,037 | A | 6/1999 | Pierson | |
| 2014/0326273 | A1* | 11/2014 | Kalyanpur | A45D 33/008 220/524 |
| 2015/0027487 | A1* | 1/2015 | Apodaca | A45D 33/006 132/307 |
| 2015/0223583 | A1* | 8/2015 | Greenfield | B65D 81/07 132/316 |
| 2016/0270507 | A1 | 9/2016 | Thompson | |
| 2017/0143098 | A1* | 5/2017 | Sugita | A45D 33/24 |
| 2020/0037729 | A1 | 2/2020 | Reid | |

FOREIGN PATENT DOCUMENTS

| | | |
|---|---|---|
| FR | 2691339 B1 | 9/1994 |
| WO | 202065184 A1 | 2/2020 |

OTHER PUBLICATIONS

French Search Report and Written Opinion dated Mar. 23, 2022, issued in corresponding French Application No. 2106888, filed Jun. 28, 2021, 6 pages.

* cited by examiner

*Primary Examiner* — Rachel R Steitz
(74) *Attorney, Agent, or Firm* — Christensen O'Connor Johnson Kindness PLLC

(57) ABSTRACT

A compact case and a method of making the compact case. The method includes the step of supporting a formulation tray having a depression formed from up an upright wall surrounding a bottom of the tray, and a flange extending outward from the exterior of the wall between a first frame that presses on top of the flange and a second frame that supports the bottom of the flange, wherein a gap separates the bottom of the formulation tray from the top of second frame.

17 Claims, 7 Drawing Sheets

REFILLABLE COMPACT CASE

SUMMARY

In terms of sustainability, refillable packaging is very important due to more and more consumers are looking for eco-friendly alternatives. Offering refillable options are often also wallet friendly.

This disclosure relates to refillable compacts, such as makeup compact cases. The refillable compact has an exterior case with a compartment for holding a removable interior tray that contains the formulation. The exterior case can be made from quality materials that can last for an extended period such that they are not thrown away or disposed of after exhausting the formulation, and the interior tray can be made from less expensive and lightweight materials that can be replaced with a new tray when the formulation is exhausted.

In one embodiment, the compact case is easily refilled by the consumer. There can be a wide variety of choices for the replacement tray and formulation.

In one embodiment, the case can include a mirror on a hinged frame. The hinged frame can be used to secure the tray in place.

In one embodiment, the compact case provides easy open and close mechanisms for the consumer, and provides secure holding of the tray during usage to allow swiping with a brush or pad.

In one embodiment, the refillable compact case can use less plastics for the same amount of bulk as conventional disposable, non-refillable compacts.

The use of a refillable compact with replaceable tray produces less waste overall and makes for an eco-friendly option as compared to disposable compacts.

In one embodiment, the compact case has a removable vacuum-formed formulation tray that has flanges to support the removable vacuum-formed tray, such that the tray is securely sandwiched between a hinged bottom frame and top frame.

In one embodiment, the flanges are located at a sufficient height on the tray to cause a gap between the bottom of the formulation tray and bottom frame. The gap allows for shock adsorption from impacts, such as dropping.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
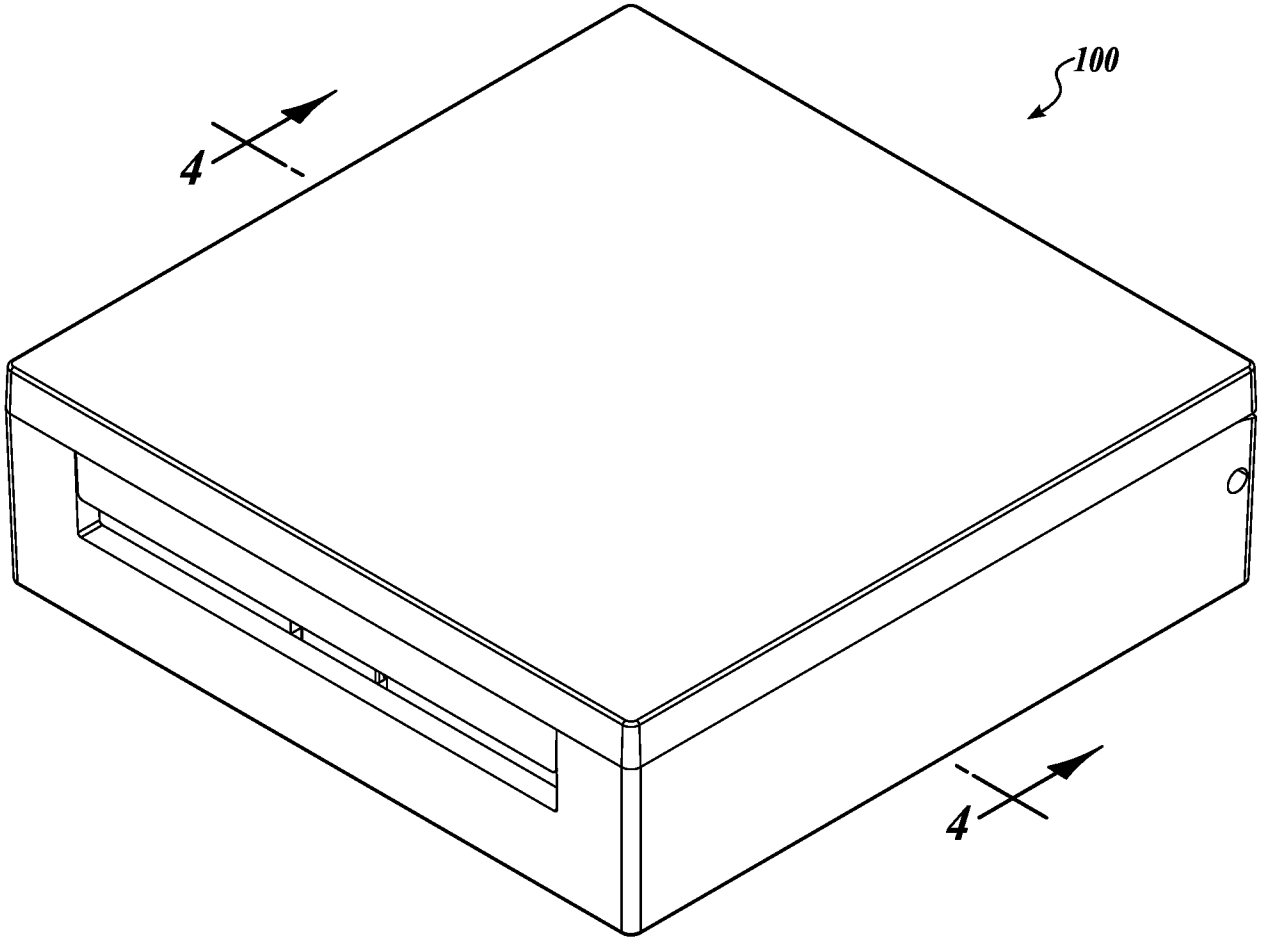
FIG. 1 is a diagrammatical illustration of a compact case.

FIG. 1 is an illustration of one embodiment of a compact case 100. In one embodiment, the compact case 100 can be used to contain makeup, such as a pressed powder cake used for blush, eye shadow, and the like. In one embodiment, the pressed powder cake is provided in a removable tray that permits the user to replace the tray with a different formulation by changing the tray. A plurality of trays, each with a different formulation, can be made available to the user such that the user can select which tray and formulation to place within the compact case 100. In one embodiment, the formulation can include pressed powder cakes; however, in other embodiments, the formulation can include salves, gels, ointments, creams, lotions, and the like. In one embodiment, the overall shape of the compact case 100 is square or rectangular. In one embodiment, the front, back, right side, and left side views of the compact case are rectangular. However, the compact case can be made using other shapes including, rectangular, circular, oval shapes, or combinations. In order words, the compact case 100 and the interior parts can be constructed such that a top and bottom plan view is rectangular, circular, or oval, and side views of the compact case 100 in which the side view is rectangular, circular, or oval.

Figure 2:
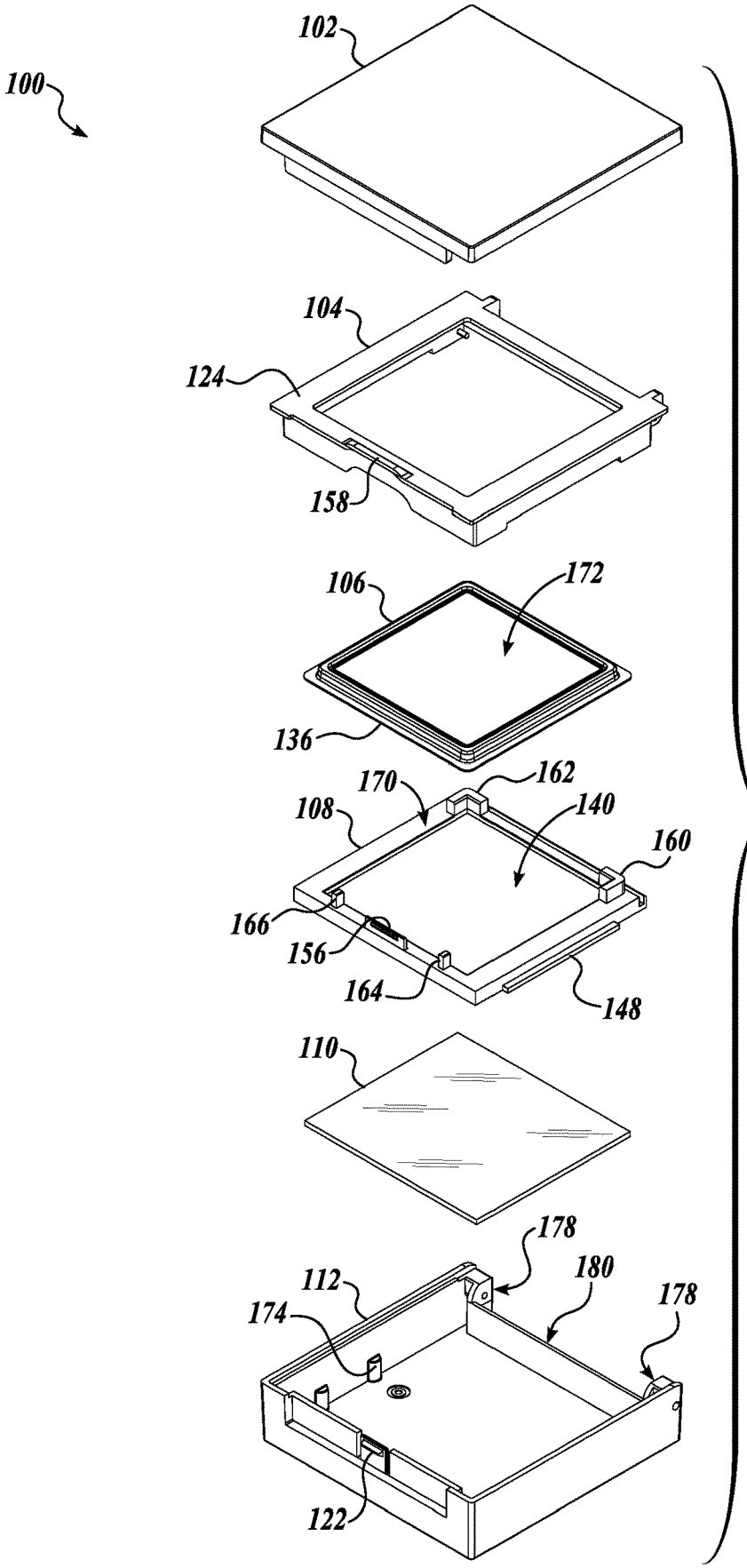
FIG. 2 is a diagrammatical exploded view illustration of the compact case of FIG. 1.
Figure 3:
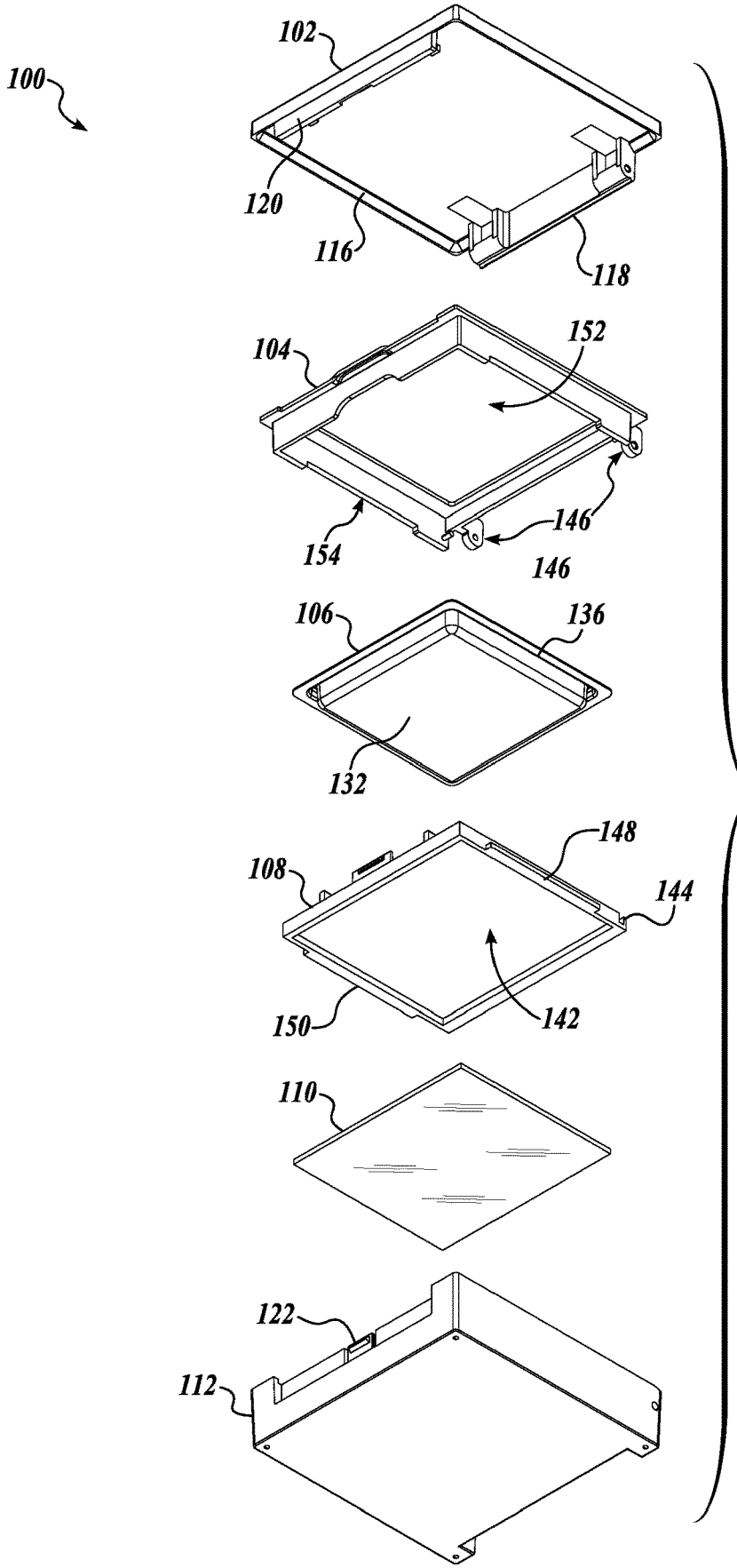
FIG. 3 is a diagrammatical exploded view illustration of the compact case of FIG. 1.

FIGS. 2 and 3 illustrate individual parts used in one embodiment of the compact case 100. In one embodiment, the compact case 100 includes a lid 102, a top frame 104, a formulation tray 106, a bottom frame 108 (or 208), a mirror 110, and a bottom tray 112. Herein, "top" frame and "bottom" frame can also be referred to as "first" frame and "second" frame, respectively. In one embodiment, the lid 102 and bottom tray 112 form a box-shaped container in which the top frame 104, formulation tray 106, bottom frame 108 (or 208) and mirror 110 are enclosed. Accordingly, the top frame 104, formulation tray 106, bottom frame 108 (or 208) and mirror 110 are correspondingly shaped to fix within a box, meaning they have four sides, including a right and left sides, and a front and back sides. However, other shaped containers can be formed and the top frame 104, formulation tray 106, bottom frame 108 (or 208) and mirror 110 would be formed to fit within the shape of the container. In this application, spatial terms, such as right, left, front, back, top, bottom, and the like, may be used to describe the elements shown in the figures, for example, to describe one element's relationship to another element(s). It will be understood that the spatially relative terms are intended to encompass different orientations of the apparatus in use or operation in addition to the orientation depicted in the figures.

In one embodiment, the lid 102 has a solid flat top and a shallow rim 116 extending below and around the top of the lid 102. The rim 116 extends from the outermost edge of the solid flat top. In one embodiment, the lid 102 includes a hinge 118 at the rear of the lid 102 which connects the lid 102 to the bottom tray 112 and allows the lid 102 to swing open. The hinge 118 can be can fit in and be secured within a slot 180 at the back of the bottom frame 112. In one embodiment, the bottom tray 112 includes a clasp 122 on the front side. In one embodiment, the clasp 122 functions to keep the lid 102 closed. The lid 102 is opened when an upward pressure is exerted on the front of the lid to overcome the resistance of the clasp 122. The clasp 122 may, for example, utilize anyone of a number press fit clasps such as a flexible tab of reduced thickness material with a rib extending on the front that engages with a corresponding groove on the lid 102.

Figure 4:
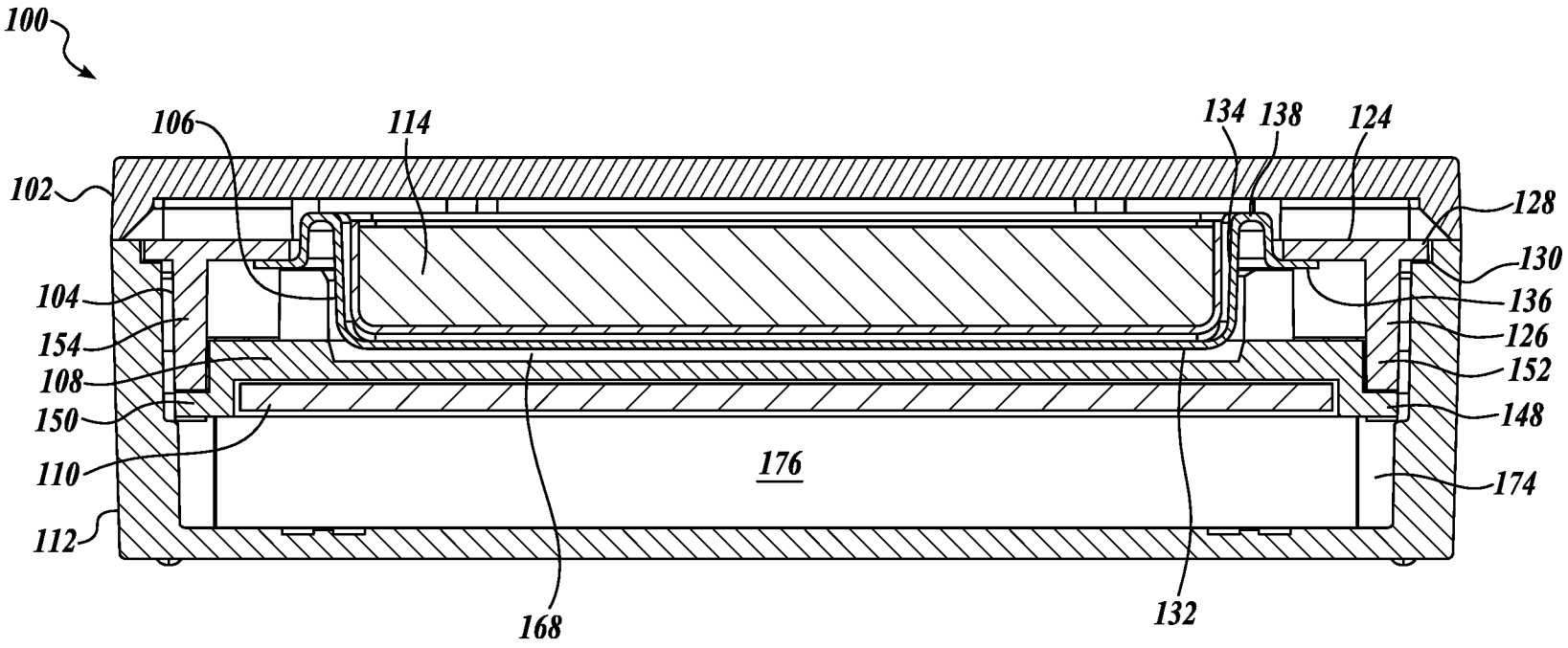
FIG. 4 is a diagrammatical cross-sectional illustration of the compact case of FIG. 1.

In one embodiment, the top frame 104 has a flat upper border 124 surrounding a square opening. A rim 126 extends down from and perpendicular from the bottom of the border 124. The rim 126 is placed close to but on the inside the outermost edges of the border 124 so that there is an overhang 128 from the border 124 as seen in FIG. 4. The overhang 128 rests on an inside shoulder 130 formed on the upper inside edge of the bottom tray 112 as seen in FIG. 4.

In one embodiment, the formulation tray 106 has a closed square bottom 132 with an upright wall 134 extending perpendicular from the bottom 132. In one embodiment, the upright wall 134 extends around the entire periphery of the bottom 132, thereby forming a depression 172 within the center of the tray 106, wherein such depression 172 is formed out of the upright wall 134 and bottom 132, and with no top. Any formulation 114 may be provided within the depression 172 as seen in FIG. 4. In one embodiment, the tray 106 has a single depression. However, in one embodiment, the tray 106 can be created with multiple depressions to provide a variety of different formulation options in a single tray. The tray 106 has an open top to allow access to the tray 106 and the formulation 114 therein from the opening in the top frame 104, after the lid 102 has been raised.

In one embodiment, the tray 104 is made through a vacuum forming method from a single sheet of material. In one embodiment, the tray 104 is formed from a monolithic (single piece) sheet of material. In one embodiment, the tray 104 can have a uniform or similar thicknesses throughout the bottom 132, wall 134, and flange 136, excluding bends in the material that can form thin or thick spots. In one embodiment, polyethylene terephthalate (PET) is used for the tray material. In one embodiment, the tray material is any biodegradable material, including polylactic acid, starch-based resins, polyhydroxyalkanoates, and polycaprolactone, for example. In one embodiment as seen in FIG. 4, the upright wall 134 extends from the bottom 132 to the maximum height of the wall, where there is a bend 138 that turns outwards and horizontal from the generally vertical, then down or nearly vertical, and then generally horizontal outward again to form a flange 136 extending outward around the outer periphery of the wall 134 at a height that is about the middle of or higher from the wall 134. In one embodiment, the dimensions of the tray are determined by the dimensions of the top frame 104 and bottom frame 108, such that the flange 136 is at a height to keep the bottom of the tray 106 separated from the top of the bottom frame 108. In one embodiment, the flange 136 has a similar thickness to the wall 134 as both are made from the same monolithic sheet. In one embodiment, the flange 136 presents a generally horizontal flat surface area on top of the flange 136 and a generally horizontal flat surface area on the underside of the flange 136. The outward dimension of the flange 136, i.e., the dimension that extends away from the wall 134 can be several millimeters to several centimeters, thereby providing adequate surface area for supporting the flange 106 between the top frame 104 and the bottom frame 108. The flange 136 can be pressed down by the bottom inner side of the border 124 of the top frame 104 onto the bottom frame 108.

In one embodiment, although the flange 136 is shown around the entire periphery of the tray wall 134, the flange can be discontinuous and may only be provided on certain sides of the tray or any sections thereof. In one embodiment, the height of the flange 136 on the tray wall 134 is set to be a height that will leave a gap 168 between the bottom 132 of the tray 106 and the top of the bottom frame 108.

In one embodiment, the bottom of the formulation tray 106 rests above, but does not touch the top side of the bottom frame 108, thereby leaving the gap 168 between the bottom frame 108 and the formulation tray 106 as seen in FIG. 4. The gap 168 separates the entire width and length of the bottom of the formulation tray 106 from the top of the bottom frame 108. That is, the gap 168 extends in the side to side dimension and the front to back dimension, such that the entire bottom 132 of the formulation tray does not touch the top of the bottom tray 108. In one embodiment, the gap 168 is about 0.6 mm. In one embodiment, the gap 168 can be in the range from 0.1 mm to 1 mm or greater. In one embodiment, the gap 168 can be about 0.1 mm, about 0.2 mm, about 0.3 mm, about 0.4 mm, about 0.5 mm, about 0.6 mm, about 0.7 mm, about 0.8 mm, about 0.9 mm, about 1 mm, or within any range using the foregoing as lower and upper endpoints of the range. In one embodiment, the gap 168 can allow some movement of the tray 106 to withstand sudden shocks from impacts such as dropping to prevent the pressed powder cake from breaking.

Figure 5:
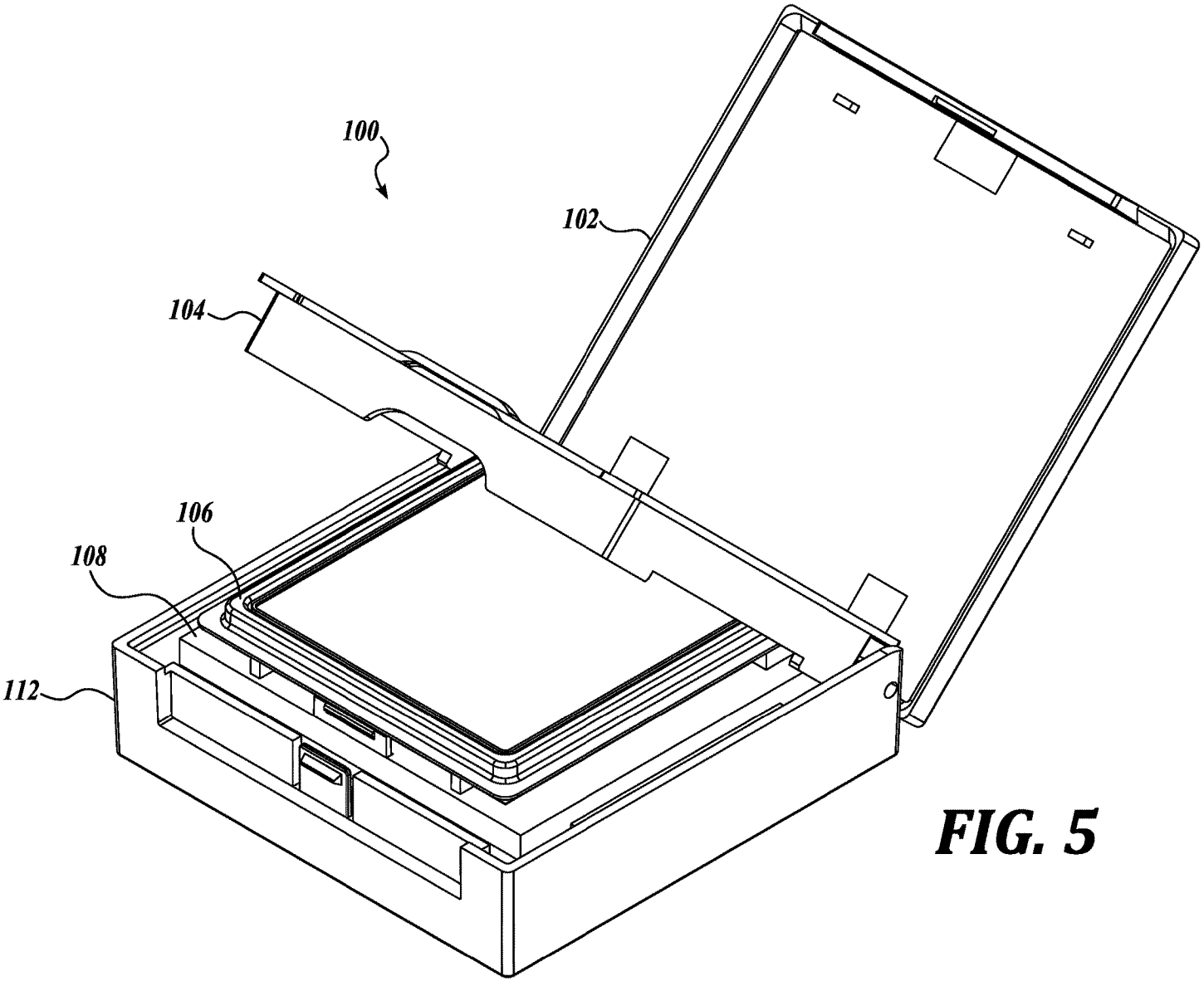
FIG. 5 is a diagrammatical illustration of the compact case of FIG. 1 in an open position to remove the formulation tray.

In one embodiment, the bottom frame 108 is a solid flat thin plate from front to back and side to side. A recess 140 or depression generally in the form of a square can be formed on the upper side of the bottom frame 108 which creates a square border 170 around the recess 140. The recess 140 can receive, but not touch the bottom 132 of the formulation tray 106. A recess 142 can be formed on the underside of the bottom frame 108 leaving a border surrounding the recess 142. In one embodiment, the recess 142 can receive the mirror 110. However, the mirror 110 is optional. In one embodiment, the bottom frame 108 has one half of a hinge 144 placed at the rear on the right side and comprising of a slotted groove. A similar hinge is placed at the rear on the left side, but is not visible. The top frame 104 has the second half of a hinge 146 placed at the rear and comprising of respective right and left side ears with openings. Then, the bottom tray 112 has pockets 178 at the back on the right and left sides to receive the hinges 144 and 146 of the top frame 104 and the bottom frame 108. The hinge 144 of the bottom frame 108, therefore, is connected to the hinge 146 of top frame 104 allowing the top frame 104 to swing up as illustrated in FIG. 5. In one embodiment, the same hinge 144 of the bottom frame 108 and the same hinge 146 of the top frame 104 are also connected to the bottom tray 112; therefore, the bottom tray 108 can also swing up (together with the formulation tray 106 and top frame 104) from the bottom tray 112. In any case, hinge mechanisms are provided on the top frame 104 and on the bottom frame 108 to allow the top frame 104 to swing up with respect to the bottom frame 108, and to allow the bottom frame 108 to swing up from the bottom tray 112. Additionally, the lid 102 is configured to swing up from the bottom tray 112, thereby also having hinge mechanisms on the lid 102 and bottom tray 112.

In one embodiment, the top of the bottom frame 108 can have discrete alignment blocks 160 and 162 extending upright along the top border 170 of the bottom frame 108. Alignment blocks 160, 162 have ninety degree bends to center the formulation tray 106 with respect to the bottom frame 108. The top of the alignment blocks 160, 162 receive the underside of the flange 136. The top of the bottom frame 108 can also have blocks 164, 166 extending upward at the front of the bottom frame 108 to prevent the formulation tray 106 from sliding forward. Similarly, the top of the blocks 164, 166, receive the underside of the flange 136. Therefore, the stand-off blocks 160, 162, 164, and 166 hold the formulation tray 106 such that the formulation tray 106 is resting by the flange 136 on the bottom frame blocks 160, 162, 164, and 166, such that the bottom of the formulation tray 106 does not contact the top of the bottom frame 108 as seen in FIG. 4. In one embodiment, having only discrete blocks supporting the underside of the flange 136 can allow for more shock and impact absorption and flexibility of the tray as compared to supporting the underside of the flange 136 fully around the flange 136. However, in one embodiment, the support for the underside of the flange 136 can be made continuous so that the entire underside of the flange 136 makes contact with a supporting structure. The dimensions, including the height, side to side and front to back dimensions of the top frame 104 and the bottom frame 108 are based on the dimensions of the tray 106, such that the tops of the blocks 160, 162, 164, and 166 are aligned with the flange 136. Further, the border 124 of the top frame 104 is also configured based on the dimensions of the tray 106 and the flange 136.

As seen in FIG. 4, the top frame 104, and in particular the underside of the inner border 124 contacts and can press down on the flange 136 of the formulation tray 106. The tray 106 being supported from blocks on the bottom frame 108 is compressed between the top frame 104 and the bottom frame 108, with the flange 136 taking the force of compression. The flange 136 may allow some distortion of the center of the tray 106 due to the bend 138 of material at the top of the formulation tray 106. Further, while the formulation tray 106 is held by the flange 136, and the flange 136 is attached in a way that allows distortion, the flange 136 and bend 138 can provide a spring-like shock absorbing element that prevents the cake 114 from being dislodged or broken.

Further, as illustrated in FIG. 2, the bottom frame 108 has a dog 148 on the right side and a dog 150 on the left side. The dogs 148, 150 extend outward and parallel to the side from the lower edge of the bottom frame 108 as seen in FIG. 4. The top frame 104 has corresponding cutouts 152, 154, at the lower edge of the rim 126 on the respective right and left sides as seen in FIGS. 3 and 4. Engagement of the cutouts 152, 154 with the dogs 148, 150 provide bottoming out of the top frame 104 with the bottom frame 108. In one embodiment, the dogs 148, 150 can also be used to support the bottom frame 108 on the bottom tray 112. In one embodiment, the bottom tray 112 has posts 174 extending upright attached to the inside wall of the bottom tray 112. Therefore, the dogs 148, 150 rest on top of the posts 174 as seen in FIG. 4. Further, an additional space or cavity 176 can be created within the bottom tray 112 by resting the bottom frame 108 on elevated posts 174. The cavity 176 can be used for storing applicator brushes or pads, for example.

In one embodiment, the front side of the bottom frame 108 has a clasp 156 that engages with the front end of the top frame 104 to keep the top frame 104 closed with respect to the bottom frame 108 and thereby securing the formulation tray 106. The clasp 156 can be a flexible tab of reduced thickness material with a rib protruding toward the front, such that the rib can engage within a slot formed on the inside of the front of the rim 126. The lid 102 has an elongated tab 120 with the corresponding mating part for the clasp 122. In one embodiment, the top frame 104 can have a handle 158 to disengage the top frame 104 from the bottom frame 108.

In one embodiment, when the top frame 104 is clasped to the bottom frame 108, the assembly of the top frame 104, formulation tray 106, and bottom frame 108 can swing up together as a unit to reveal the mirror 110 attached underneath the bottom frame 108. The bottom tray 112 has a depth to accommodate the combined height of the top frame 104, formulation tray 106, and bottom frame 108. Further, the depth of the bottom tray 112 may also include a lower compartment when the assembly is swung up. Such lower compartment can be used to hold a sponge/applicator.

Figure 6:
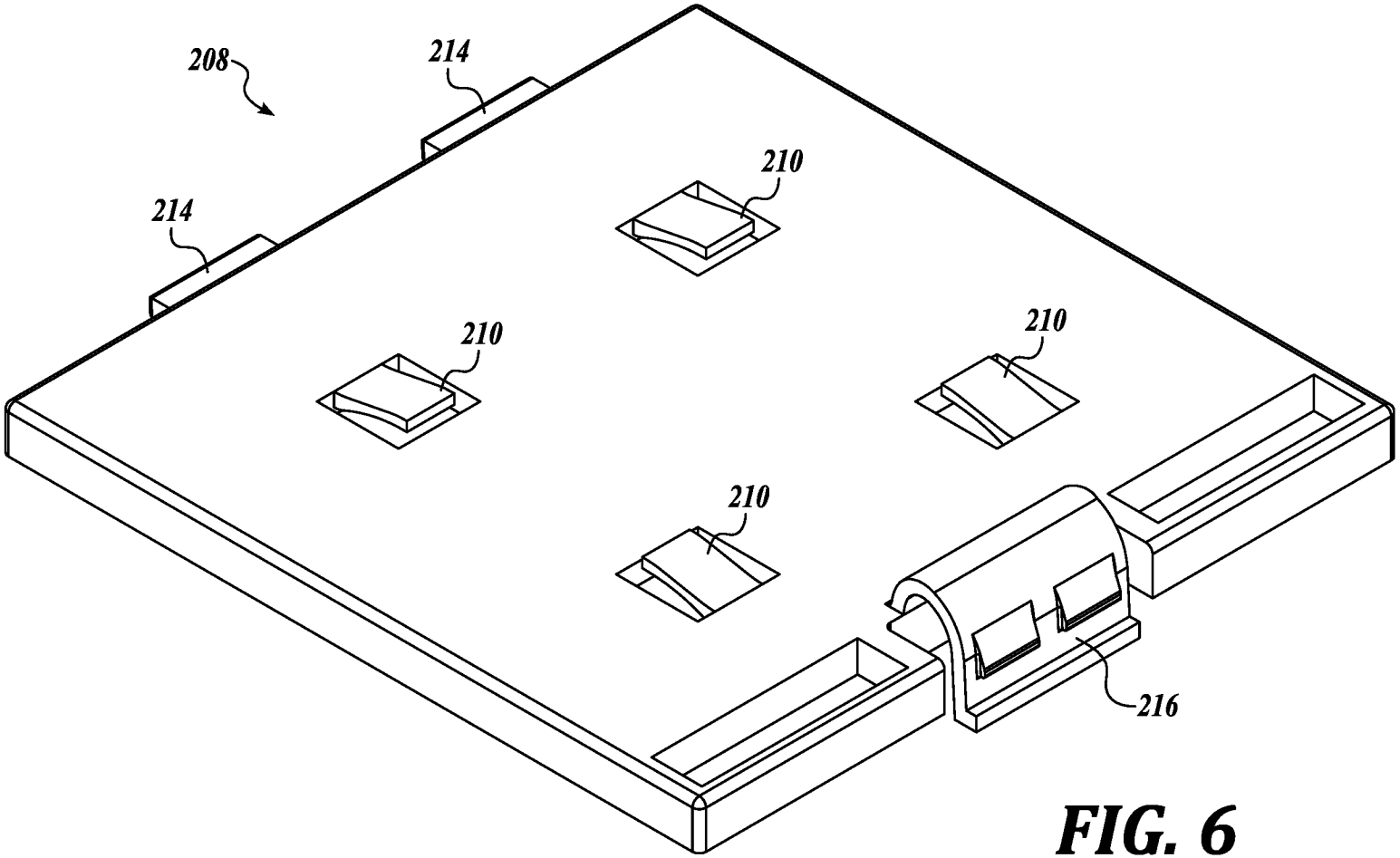
FIG. 6 is a diagrammatical illustration of an alternative construction of the bottom frame used in the compact case of FIG. 1.

In one embodiment, referring to FIG. 6, an alternative to the bottom frame 108 is the bottom frame 208 with spring tabs 210 extending up from the top surface of the bottom frame 208. The spring tabs 210 are flexible such that the spring tabs 210 can deform at least in the up and down direction to absorb impacts. In the case of bottom frame 208, the formulation tray 106 is located above the bottom frame 208 such that the underside of the bottom 132 of the formulation tray 106 touches and makes contact with the tops of the spring tabs 210. Spring tabs 210 can be formed from a piece of material bent upwards. For example, the top flat surface of the bottom frame 208 can be cut out on three sides surrounding each spring tab 210, and the spring tab 210 is bent upward. In one embodiment, four spring tabs 210 are used, each one being placed inward from each of the four corners of the bottom frame 208. Other parts of the bottom frame 208 can be similar to the bottom frame 108, including size and shape. For example, the bottom frame 208 has a suitable front clasp that locks with the front of the top frame 104. The bottom frame 208 has a rear hinge that cooperates with the hinges of the top frame 104 and bottom tray 110 to allow the top frame 104 to swing up with respect to the bottom frame 208 and also allows the bottom frame 208 to swing up with respect to the bottom tray 112. When the bottom frame 208 is substituted for bottom frame 108, the gap 168 is still present between the bottom 132 of the formulation tray 106 and the top of the bottom frame 208. However, in the case of bottom frame 208, the gap 168 does not extend the entire width and length of the bottom 132 of the formulation tray 106. In the case of the bottom frame 208, the gap 168 extends over a majority of the width and length of the bottom 132 of the formulation tray 106, the exceptions being the areas of the bottom 132 contacting the tops of the spring tabs 210 leaving no gap therebetween.

In one embodiment, the bottom frame 208 does not have the alignment blocks of bottom frame 108. In one embodiment, when the bottom frame 208 is used in the compact case 100, the flange 136 of the formulation tray 106 is not supported by the bottom frame 208, instead the bottom frame 208 supports the formulation tray 106 by contact through the spring tabs 210.

Figure 7:
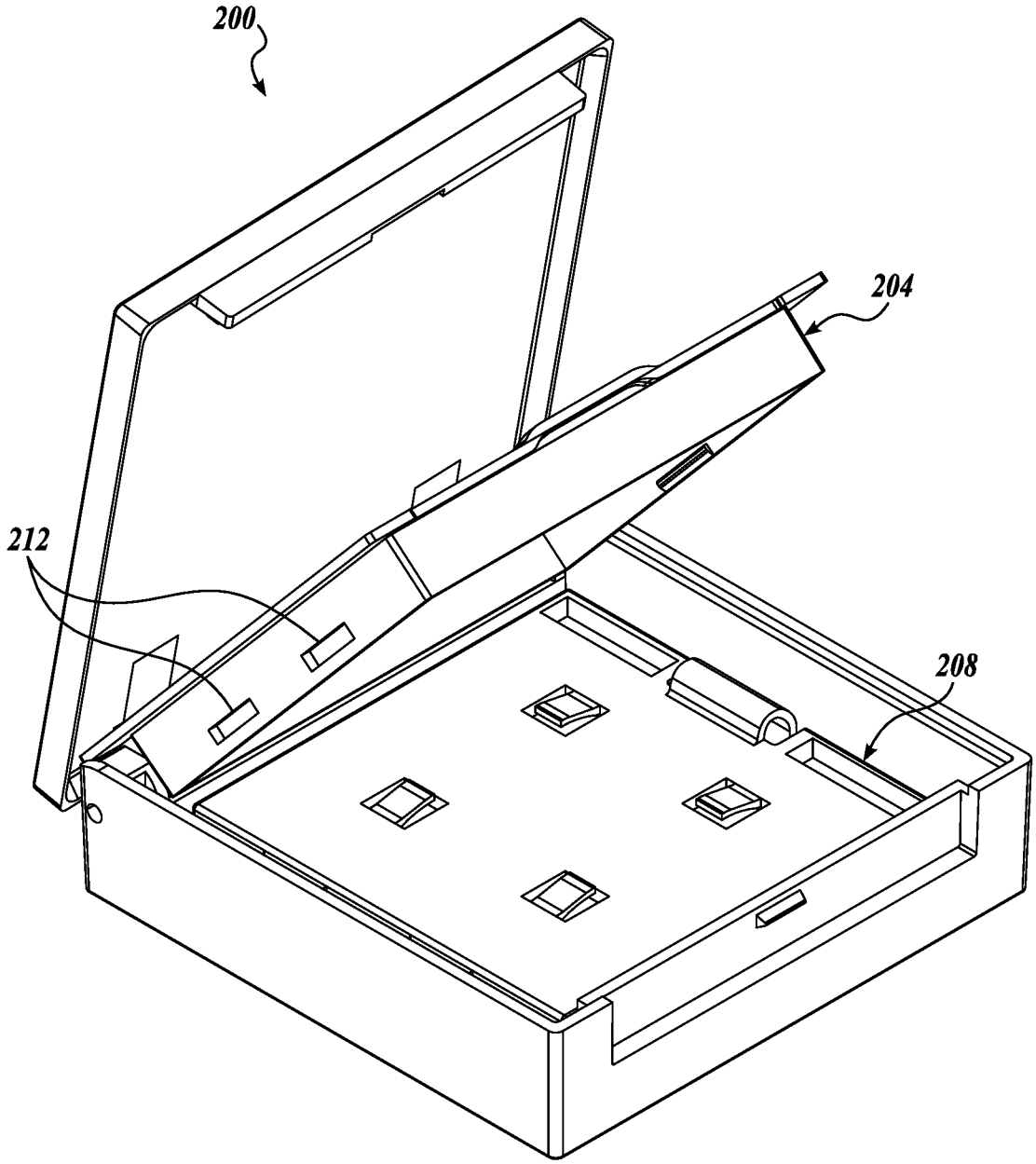
FIG. 7 is a diagrammatical illustration of the bottom frame of FIG. 6 and a modified top frame.

FIG. 7 is an illustration showing the bottom frame 208 in a compact case 200. In one embodiment, an alternative top frame 204 is used with the bottom frame 208. The top frame 204 has many of the features described in association with top frame 104. The differences are noted herein. The top frame 204 has notches 212 made in the left side of the downward projecting rim 126. The notches 212 are for receiving the tabs 214 on the side of the bottom frame 208 as seen in FIG. 6. Therefore, the bottom frame 208 is held to one side of the top frame 204 via the tabs 214 and on the opposite side of the bottom frame 208, the clasp 216 locks onto the corresponding side of the rim on the top frame 204, thereby allowing the formulation tray 106 to be enclosed between the top frame 204 and the bottom frame 208. Further, the bottom frame 208 can be disassembled from the top frame 204 in order to replace the formulation tray 106 by undoing the clasp 216.

As described, the compact case 100 allows securing a pressed-powder cake 114 in the removable formulation tray 106, and the top frame 104 and the bottom frame 108 sandwich the formulation tray 106 by holding the flange 136 of the tray 106. The flange 136 thickness is controlled by the resin sheet, the thickness of which can be controlled with very tight tolerances. Thereby, the formulation tray 106 is firmly secured in the compact case 100 without any movement in normal use, but also allows shock absorption to withstand impacts.

Also, another function of formulation tray 106 is to protect the pressed powder cake 114 during normal shipping, handling, and use conditions. The formulation tray 106 is made from thin material to be flexible which will absorb the energy from any external shocking and vibration. Additionally, the parts of the compact case 100, including the lid 102, top frame 104, bottom frame 108, and bottom tray 112 can be made from durable materials made to last and have more higher end finishes, which can present an attractive exterior, while the replaceable, disposable formulation tray 106 has environmental benefits due to much lighter component weight. In one embodiment, the lid 102, top frame 104, bottom frame 108, and bottom tray 112 are made from one or more of acrylonitrile butadiene styrene (ABS), polyethylene terephthalate glycol-modified (PETG), and styrene acrylonitrile (SAN).

While illustrative embodiments have been illustrated and described, it will be appreciated that various changes can be made therein without departing from the spirit and scope of the invention.

The embodiments of the invention in which an exclusive property or privilege is claimed are defined as follows:

1. A compact case, comprising:

a formulation tray having a depression formed from up an upright wall surrounding a bottom of the tray, and a flange extends outward from the exterior of the wall, a bend between the upright wall and the flange, wherein the bend is formed beginning at a maximum height of the upright wall where the upright wall turns outwards, then down, and then horizontally outward to the flange, and wherein a height of the flange is less than the maximum height of the upright wall;

a first frame that presses on top of the flange; and a second frame that supports the formulation tray, wherein a gap separates the bottom of the formulation tray from the top of second frame.

2. The compact case of claim 1, wherein the formulation tray includes a pressed powder cake within the depression.

3. The compact case of claim 1, wherein the first frame and second frame are connected via a hinge that allows the first frame to swing up.

4. The compact case of claim 3, wherein the first frame and second frame are further connected with a clasp.

5. The compact case of claim 1, wherein the first frame, the formulation tray, and the second frame are connected into an assembly that swings up as the assembly with respect to the compact case.

6. The compact case of claim 5, further comprising a mirror placed on the underside of the second frame that is revealed when the assembly swings up.

7. The compact case of claim 1, comprising a lid and a bottom tray, wherein the lid and the bottom tray are connected via a hinge and a clasp, and the first frame, the formulation tray, and the second frame are enclosed within the lid and bottom tray.

8. The compact case of claim 1, wherein the first frame has a border framing an opening, wherein the underside of the border presses on the flange.

9. The compact case of claim 8, wherein the second frame has blocks extending upright from a border of the bottom frame, and the underside of the flange rests on the blocks.

10. The compact case of claim 1, wherein the tray is made from polyethylene terephthalate, polylactic acid, starch-based resins, polyhydroxyalkanoates, or polycaprolactone.

11. The compact case of claim 1, wherein separation from the bottom of the tray to a top of the second frame is from 0.1 mm to 1 mm.

12. The compact case of claim 1, wherein the tray is a monolithic sheet that has a substantially uniform thickness, and a flange thickness is similar to an upright wall thickness.

13. The compact case of claim 1, wherein the gap extends throughout an entire width and length of the bottom of the formulation tray.

14. The compact case of claim 1, wherein the gap extends throughout a majority of a width and length of the bottom of the formulation tray.

15. The compact case of claim 14, wherein spring tabs on a top of the second frame contact the bottom of the formulation tray and leave no gap therebetween.

16. The compact case of claim 1, wherein the second frame supports the formulation tray at an underside of the flange.

17. The compact case of claim 1, wherein the second frame supports the formulation tray from an underside of the bottom of the formulation tray.

* * * * *